United States Patent [19]

Ishimaru

[11] Patent Number: 4,578,085

[45] Date of Patent: Mar. 25, 1986

[54] APPARATUS FOR LIQUID FLOW TREATMENT OF FABRICS

[75] Inventor: Osamu Ishimaru, Matsubara, Japan

[73] Assignee: Hisaka Works, Ltd., Osaka, Japan

[21] Appl. No.: 673,264

[22] Filed: Nov. 20, 1984

[30] Foreign Application Priority Data

Sep. 13, 1984 [JP] Japan ..... 59-190612

[51] Int. Cl.[4] ..... D06B 3/28

[52] U.S. Cl. ..... 8/152; 26/21; 26/87; 68/177

[58] Field of Search ..... 68/177, 178; 26/20, 26/21, 87, 105, DIG. 1; 162/271; 8/152

[56] References Cited

U.S. PATENT DOCUMENTS

| | | | |
|---|---|---|---|
| 3,016,728 | 1/1962 | Mann et al. | 68/177 |
| 3,782,138 | 1/1974 | Kawasaki et al. | 68/177 |
| 4,392,365 | 7/1983 | Miyamoto et al. | 68/177 X |
| 4,474,039 | 10/1984 | Yamada | 68/177 |

FOREIGN PATENT DOCUMENTS

| | | | |
|---|---|---|---|
| 2327348 | 5/1977 | France | 68/177 |
| 1587069 | 3/1981 | United Kingdom | 68/178 |

*Primary Examiner*—Philip R. Coe

*Attorney, Agent, or Firm*—Robert E. Burns; Emmanuel J. Lobato; Bruce L. Adams

[57] ABSTRACT

An apparatus for the liquid flow treatment of fabrics in which a fabric is set in the form of an endless rope and the fabric and a treating liquid are circulated to effect the liquid flow treatment, the apparatus comprising a lateral cylindrical fabric reservoir tank for storing and delivering the fabric, which tank has an inclined rear portion so that the depth of the treating liquid is gradually increased in the direction of advance of the fabric, a header portion arranged above an inlet part of the tank and provided in the interior thereof with a fabric driving reel or roll for pulling up the fabric from the tank, a treating liquid jet nozzle connected to an outlet part of the header portion to generate a stream of the treating liquid, a fabric delivery tube extended from the jet nozzle to a fabric inlet part of the rear portion of the tank to deliver the fabric substantially linearly together with the treating liquid stream generated by the jet nozzle, a fabric-expanding plate which is arranged so that the width of a fabric path is expanded at an outlet part of the delivery tube, scrays arranged at the fabric outlet and inlet parts of the tank to smoothly deliver the fabric, and a treating liquid circulation passage for circulating the treating liquid while sucking the treating liquid from the bottom of the tank and supplying the treating liquid to the jet nozzle.

19 Claims, 5 Drawing Figures

APPARATUS FOR LIQUID FLOW TREATMENT OF FABRICS

BACKGROUND OF THE INVENTION

1. Field of the Invention

The present invention relates to an apparatus for the liquid flow treatment of fabrics. More particularly, the present invention relates to an apparatus for the liquid flow treatment of fabrics, in which a fabric to be treated is set in the form of an endless rope and the fabric to be treated and a treating liquid are circulated to effect the liquid flow treatment.

2. Description of the Related Art

A so-called liquid flow treatment apparatus in which a fabric to be treated is set in the form of an endless rope and the fabric to be treated and a treating liquid are circulated to effect the liquid flow treatment is well-known. In the liquid flow treatment of textile fabrics using this treatment apparatus, various proposals have recently been made to reduce the treating bath ratio for perfoming the treatment efficiently and to accomplish smooth delivery of fabrics and effective circulation of a treating liquid (see, for example, Japanese Examined Patent Publications Nos. 55-40877 and 58-19786, Japanese Unexamined Patent Publications Nos. 57-66166 and 58-186656, and Japanese Unexamined Utility Model Publication No. 59-33793). However, apparatuses according to these proposals are not completely sufficient for performing the treatment efficiently, and it is desired that these apparatuses will be improved in some points or others.

SUMMARY OF THE INVENTION

It is a primary object of the present invention to provide an apparatus in which smooth delivery of a fabric to be treated and effective circulation of a treating liquid are accomplished and the liquid flow treatment of fabrics can be performed sufficiently efficiently even at a low bath ratio. Namely, the present invention is to solve the problems of the conventional techniques concerning the delivery of a fabric to be treated and the circultation of a treating liquid.

In accordance with the present invention, there is provided an apparatus for the liquid flow treatment of fabrics in which a fabric to be treated is set in the form of an endless rope and the fabric to be treated and a treating liquid are circulated to effect the liquid flow treatment, said apparatus comprisnig a lateral cylindrical fabric reservoir tank for storing and delivering the fabric, which reservoir tank has a rear portion which is inclined so that the depth of the treating liquid is gradually increased in the direction of advance of the fabric, a header portion arranged above an inlet part of said fabric reservoir tank and provided in the interior thereof with a fabric driving reel or roll for pulling up the fabric from the fabric reservoir tank, a treatig liquid jet nozzle connected to an outlet part of the header portion to generate a stream of the treating liquid, a fabric delivery tube extended from said treating liquid jet nozzle to a fabric inlet part of the rear portion of the fabric reservoir tank to deliver the fabric substantially linearly together with the treating liquid stream generated said treating liquid jet nozzle, a fabric-extending plate which is arranged so that the width of a fabric path is expanded at an outlet part of the fabric delivery tube, scrays arranged at the fabric outlet part and fabric inlet part of the fabric reservoir tank to smoothly deliver the fabric, and a treating liquid circulation passage for circulating the treating liquid while sucking the treating liquid from the bottom of the fabric reservoir tank and supplying the treating liquid to the treating liquid jet nozzle.

DESCRIPTION OF THE PREFERRED EMBODIMENTS

In the liquid flow treatment apparatus of the present invention having the above-mentioned structure, it is preferred that a nozzle for forming a conical jet stream and a nozzle for forming a cylindrical jet stream be used in combination as the treating liquid jet nozzle, and it also is preferred that convex projections extended in the direction intersecting the moving direction of the fabric substantially at right angles be formed on the fabric contact surface of the fabric-expanding plate. Moreover, it is preferred that a second fabric-expanding plate be arranged so that the fabric which falls in the inlet part of the fabric reservoir tank after the passage through the fabric expanding plate is dropped on said second fabric-extending plate above the treating liquid level in the fabric reservoir tank. According to still another embodiment of the apparatus of the present invention, a conduit is arranged to connect said header portion to the rear portion of the fabric reservoir tank, whereby the pressure in teh apparatus is kept uniform, and a shower pipe is arranged above the treating liquid level in the upper portion of the fabric reservoir tank.

Examples of the present invention will now be described in detail with reference to the accompanying drawings.

Figure 1:
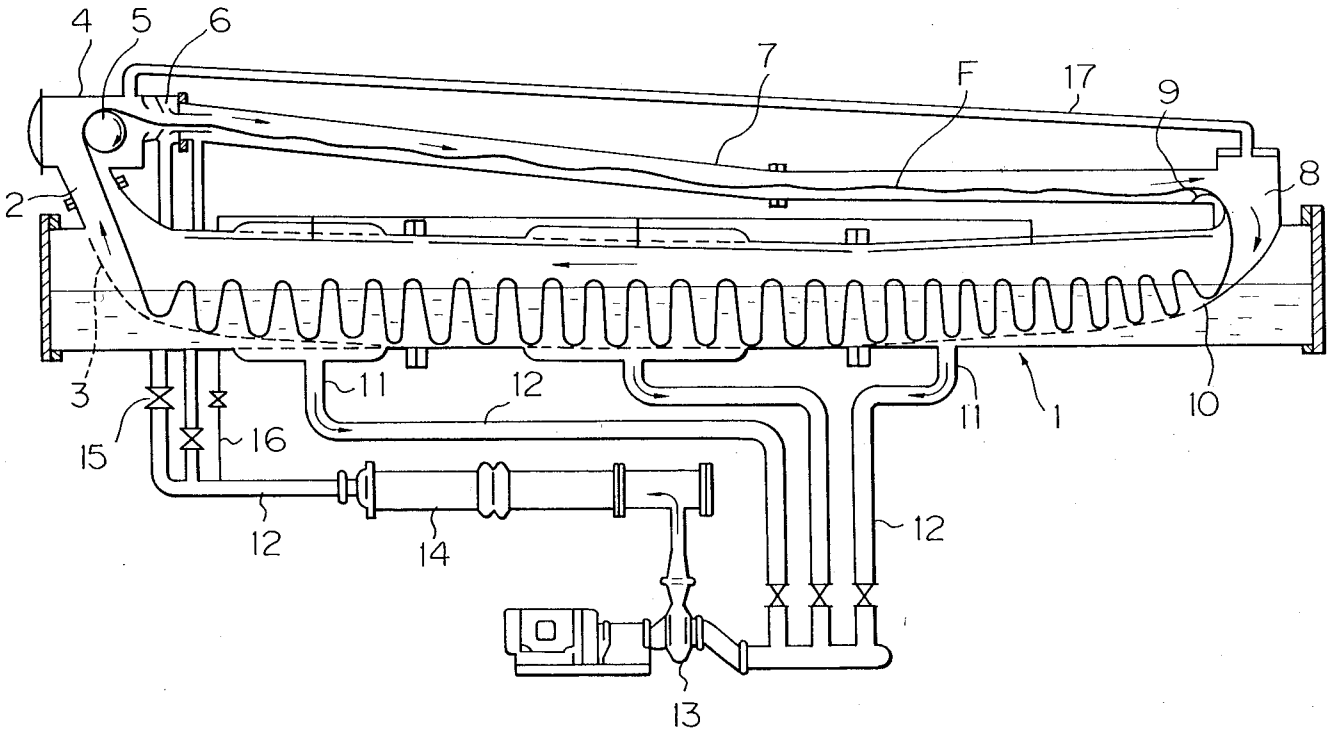
FIG. 1 is a sectional side view illustrating diagrammatically an embodiment of the liquid flow treatment apparatus of the present invention.

FIG. 1 is a sectional side view illustrating diagrammatically the liquid flow treatment apparatus of the present invention. A lateral cylindrical fabric reservoir tank 1 having a large diameter is substantially horizontally arranged, and a rear portion of the tank 1 is inclined so that the depth of the treating liquid is gradually increased in the direction of advance of a fabric F to be treated, that is, toward the center of the fabric reservoir tank 1. A fabric outlet part 2 is formed in a front portion of the fabric reservoir tank, and a hurdle-like scray 3 is arranged in the vicinity of this outlet part in the fabric reservoir tank 1 to smoothly pull up the fabric F from the fabric reservoir tank. A header portion 4 is arranged above the outlet part 2 of the fabric reservoir tank 1, and in the interior of this header portion, a fabric driving reel or roll 5 is disposed to pull up the fabric from the fabric reservoir tank and guide the fabric.

At an outlet part of the header portion 4, a treating liquid jet nozzle 6 is arranged so that it communicates with the outlet part of the header portion. A fabric delivery tube 7 is extended from this treating liquid jet nozzle to a fabric inlet part 8 communicating with the rear portion of the fabric reservoir tank 1. This fabric delivery tube 7 connects the header portion 4 to the inlet part 8 of the fabric reservoir tank 1 through the treatig liquid jet nozzle 6, and the fabric is delivered substantially linearly through the interior of the fabric delivery tube 7 together with a treating liquid stream generated by the treating liquid jet nozzle. This fabic delivery tube 7 is slightly inclined so that the level of the inlet side is slightly higher than the level of the outlet side, whereby the delivery of the fabric can be accomplished smoothly.

A fabric-expanding plate 9 is arranged at the outlet part of the fabric delivery tube 7 in such a manner that the fabric-expanding plate 9 is slightly inclined reversely with respect to the direction of advance of the treating liquid. Accordingly, the fabric F which has been delivered through the fabric delivery tube 7 together with the treating liquid stream is gradually expanded by the fabric-expanding plate 9 which is arranged so that the width of the fabric path is gradually expanded, and the fabric is dropped into the rear portion of the fabric reservoir tank 1 through the fabric inlet part 8 together with the overflowing liquid. A hurdle-like scray 10 is arranged in the vicinity of the fabric inlet part 8 so that the fabric falling from the inlet part 8 is gradually and smoothly fed into the fabric reservoir tank 1. The fabric F which has been pulled up from the fabric outlet part 2 of the fabric reservoir tank 1 having the above-mentioned structure is returned into the fabric reservoir tank 1 through the fabric inlet part 8, and in the fabric reservoir tank 1, the fabric F is delivered zigzag. Thus, the fabric F is circulated in the apparatus.

The treating liquid jetted from the treating liquid jet nozzle 6 forms a high-speed liqid stream, and the liquid stream passes through the interior of the fabric delivery tube 7 together with the fabric F and enters into the fabric reservoir tank 1 from the inlet part 8 connected to the rear portion of the fabric reservoir tank to form a liquid layer in the fabric reservoir tank. Then, the treating liquid is discharged from the fabric reservoir tank 1 through a treating liquid discharge opening 11 formed on the bottom of the liquid reservoir tank 1. The discharged treating liquid is returned to the treating liquid jet nozzle 6 through a treating liquid circulation pipe 12, a pump 13, a heat exchanger 14 and a flow rate adjusting valve 15. Incidentally, in FIG. 1, reference numeral 16 represents a liquid circulatoin pipe for a shower.

In the apparatus shown in FIG. 1, a pressure equalizing conduit 17 is arranged to connect the header portion 4 to the rear portion of the fabric reservoir tank 1, whereby the pressure in the apparatus is kept uniform.

Figure 2:
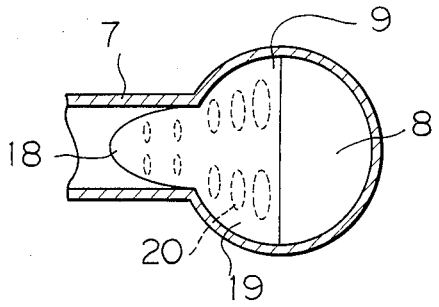
FIGS. 2 and 3 are diagrams illustrating an example of the fabric-expanding plate advantageously attached to the apparatus of the present invention.
Figure 3:
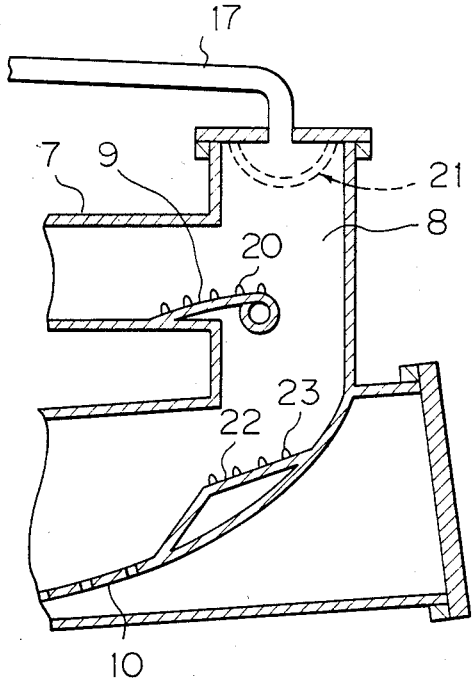

An embodiment of the fabric-expanding plate 9 is illustrated in FIGS. 2 and 3. The fabric-expanding plate 9 arranged at the outlet part of the fabric delivers tube 7 comprises a tongue 18 and a semicircular piece 19. The tongue 18 and semicircular piece 19 are constructed by a blind patch and inclined reversely to the direction of advance of the treating liquid. On the top face of the tongue 18 and semicircular piece 19, that is, on the fabric contact surface of the fabric-expanding plate 9, there are formed convex projections 20 extended in the direction intersecting the moving direction of the fabric substantially at right angles. If the fabric-expanding plate 9 having the above-mentioned structure is used, when the fabric which has been delivered through the fabric delivery tube 7 goes beyond this fabric-expanding plate 9 in an overflowing manner together with the treating liquid, the treating liquid flows in the direction intersecting the direction of advance of the fabric at right angles and therefore, a preferable expanding action is given to the fabric. Incidentally, a hurdle board 21 is perforated so that the pressure equalizing conduit 17 communicates with the rear portion of the fabric reservoir tank 1 or the fabric inlet part 8.

The fabric which has passed through the fabric-expanding plate 9 is dropped and delivered into the fabric reservoir tank from the fabric inlet part 8. A second fabric-expanding plate 22 may be arranged above the treating liquid level in the fabric reservoir tank 1, as shown in FIG. 3, so that the fabric is dropped onto this second fabric-expanding plate 22. The second fabric-expanding plate 22 is slightly inclined above the scray 10, and laterally long convex projections 23 may be formed on the second fabric-expanding fabric 22 as in case of the fabric-expanding plate 9.

Figure 4:
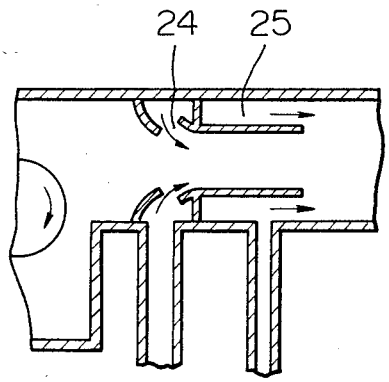
FIG. 4 is a diagram illustrating a preferred treating liquid jet nozzle.

It is preferred that a main nozzle 24 for forming a conical jet stream of the treating liquid and an auxiliary nozzle 25 for forming a cylindrical jet stream of the treating solution be arranged in combination as the treating liquid jet nozzle 6, as shown in FIG. 4. Since the jet stream of the treating liquid from the main nozzle 24 has a conical shape, this jet stream impinges slantingly against the fabric which passes through the treating liquid jet nozzle portion, and therefore, the main nozzle 24 gives a main driving force to the fabric to be delivered and circulated. The auxiliary nozzle 25 is arranged so as to increase the amount circulated of the treating liquid and smoothen the movement of the fabric in the fabric delivery tube 7, and the jet stream of the treating liquid generated by the auxiliary nozzle 25 has a cylindrical shape and flows in parallel to the direction of the length of the fabric. When the treating liquid jet nozzle having the above-mentioned structure is arranged, since the number of the circulating streams of the treating liquid is increased, the uniformity of the treatment temperature or concentration distribution in the tank is increased.

Figure 5:
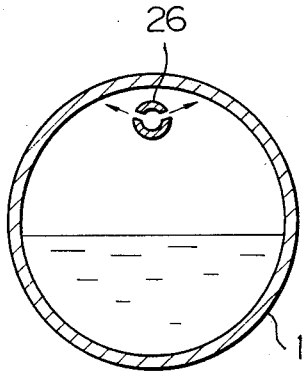
FIG. 5 is a diagram illustrating shower pipe.

A shower pipe 26 may be arranged above the treating liquid level in the upper portion of the fabric reservoir tank 1, as shown in FIG. 5. This shower pipe is connected to the treating liquid circulating pipe 16 (see FIG. 1), and a shower of the treating liquid from this shower pipe flows down on the inner wall surface of the treating liquid, whereby fluffs and yarn wastes adhering to the wall surface can be removed. Furthermore, for example, in case of carrier dyeing of a polyester/wool mixed fabric, carrier staining can be prevented.

Incidentally, the pressure equalizing conduit 17 (see FIG. 1) is arranged so as to eliminate the pressure difference produced in the apparatus. This pressure difference is produced when the volume of the fabric to be treated is large or when the fabric is raised up by bubbling of the treating liquid and the fabric reservoir tank 1 is clogged with the raised fabric. Furthermore, the fabric stored in the fabric reservoir tank is pushed forward by the pressure of the circulating air stream formed by the jet nozzle to cause an operation trouble or form wrinkles on the fabric by the pushing action. These defects are eliminated if the pressure equalizing conduit 17 is arranged to by-pass high-pressure air from the rear portion to the header portion.

When the apparatus of the present invention having the above-mentioned structure is employed, a fabric to be treated can be delivered very smoothly and a treating liquid can be circulated very efficiently, whereby the liquid flow treatment of fabrics can be accomplished very effectively.

I claim:

1. Apparatus for wet treatment of a fabric as an endless rope comprising, an elongate fabric reservoir tank for wet-treating fabrics therein as an endless rope, said fabric reservoir tank containing in use treating liquid gradually increasing in depth in a direction in which a fabric endless rope being treated is advanced longitudinally therein, a fabric delivery tube above the level of the treating liquid in said fabric reservior tank, means for lifting the fabric out of the treating liquid in said fabric reservoir tank and for introducing it into said fabric delivery tube for advancement longitudinally by a high-speed stream of treating liquid therein, means comprising a treating liquid jet nozzle for receiving treating liquid from said fabric reservoir tank and developing a jet flow treating liquid as said high-speed stream in the fabric delivery tube for advancing the fabric as an endless rope, the fabric delivery tube having a discharge end portion above the level of the treating liquid in the fabric reservoir tank for discharging the jet flow of treating liquid for return to said fabric reservoir tank and for discharging the accompanying advancing fabric, means for spreading laterally the advancing fabric as it is discharged from the fabric delivery tube comprising a fabric-spreading plate having upper surfaces defining a path of advancement for the advancing fabric over which the fabric travels relative to a path of travel in said discharge end portion of the fabric delivery tube to effectively subject the advancing fabric to lateral flow of the discharged treating liquid of said jet flow relative to said path of advancement from said discharge end portion of said fabric delivery tube to thereby spread the fabric laterally, said fabric-spreading plate terminating so that the spread advancing fabric falls downwardly therefrom accompanied with discharged treating liquid, a curved plate below the fabric-spreading plate on to which the spread fabric falls above the level of the treating liquid in said fabric reservoir tank accompanied by discharged treating liquid, and said curved plate extending into said treating liquid in said fabric reservoir tank for smoothly guiding the spread advancing fabric into said treating liquid in said fabric reservoir tank.

2. Apparatus for wet treatment of a fabric as an endless rope according to claim 1, in which said fabric-spreading plate extends as an extension of the discharge end portion of the fabric delivery tube and is progressively laterally wider than the transverse dimension of said fabric delivery tube end portion.

3. Apparatus for wet treatment of a fabric as an endless rope according to claim 1, in which said curved plate comprises a second fabric-spreading plate having means for directing lateral flow of discharged treating liquid of the jet flow accompanying the spread fabric for additionally spreading the spread fabric falling thereon.

4. Apparatus for wet treatment of a fabric as an endless rope according to claim 1, in which said fabric-spreading plate upper surfaces have thereon spaced upstanding projections over which the fabric advances while being spread, and said upstanding projections define said means for directing said lateral flow of discharged treating liquid effective for spreading the fabric laterally as it advances over said projections.

5. Apparatus for wet treatment of a fabric as an endless rope according to claim 4, including on said curved plate a second fabric-spreading plate, and upstanding projections on said second fabric-spreading plate effective similarly to said upstanding projections on the first-mentioned fabric-spreading plate.

6. Apparatus for wet treatment of a fabric as an endless rope according to claim 5, in which each of said upstanding projections is convex in vertical cross-section.

7. Apparatus for wet treatment of a fabric as an endless rope according to claim 6, in which each of said projections has a major axis substantially transverse to the path of advancement of said fabric over the projections.

8. Apparatus for wet treatment of a fabric as an endless rope according to claim 1, in which said jet nozzle comprises a first nozzle for forming a conical stream of treating liquid and a second nozzle downstream of the first nozzle for forming the treating liquid from said first nozzle into a stream cylindrical in cross section corresponding to said high-speed stream in said fabric delivery tube.

9. Apparatus for wet treatment of a fabric as an endless rope according to claim 1, including a pressure-equalizing line in communication with the interior of the fabric reservoir tank above the level of the treating liquid therein for maintaining pressure in said fabric reservoir tank substantially uniform throughout the interior thereof.

10. Apparatus for wet treatment of a fabric as an endless rope according to claim 1, including means comprising a spray pipe above the level of the treating liquid in the fabric reservoir tank for spraying treating liquid on inner wall surfaces of the fabric reservoir tank so that sprayed treating liquid flows downwardly on said inner walls removing fluffs and yarn waste, and the sprayed treating liquid is sprayed from said spray pipe for preventing stains on said fabric.

11. Apparatus for wet treatment of a fabric as an endless rope comprising, an elongate fabric reservoir tank for wet-treating fabrics therein as an endless rope, said fabric reservoir tank containing in use treating liquid gradually increasing in depth in a direction in which a fabric endless rope being treated is advanced longitudinally therein, a fabric delivery tube above the level of the treating liquid in said fabric reservoir tank, means for lifting the fabric out of the treating liquid in said fabric reservoir tank and for introducing it into said fabric delivery tube for advancement longitudinally by a high-speed stream of treating liquid therein, means comprising a treating liquid jet nozzle for receiving treating liquid from said fabric reservoir tank and developing a jet flow of treating liquid as said high-speed stream in the fabric delivery tube for advancing the fabric as an endless rope, the fabric delivery tube having a discharge end portion above the treating liquid in the fabric reservoir tank and for discharging the accompanying advancing fabric, means for spreading laterally the advancing fabric as it is discharged from the fabric delivery tube comprising a fabric-spreading plate having upper surfaces defining a path of advancement for the advancing fabric over which the fabric travels and disposed relative to a path of travel in said discharge end portion of the fabric delivery tube, and treating liquid directing means on said upper surfaces for directing treating liquid of the jet flow discharged from the fabric delivery tube transversely to the path of advancement of the advancing fabric and for effectively subjecting the advancing fabric to the lateral flow of the discharged treating liquid of said jet flow relative to said path of advancement from said discharge end portion of said fabric delivery tube to thereby spread the fabric laterally while it advances longitudinally, said fabric-spreading plate terminating so that the spread advancing fabric falls downwardly therefrom accompanied with discharged treating liquid, a curved plate below the fabric-spreading plate on to which the spread fabric falls above the level of the treating liquid in said fabric reservoir tank accompanied by discharged treating liquid, and said curved plate extending into said treating liquid in said fabric reservoir tank for smoothly guiding the spread advancing fabric into said treating liquid in said fabric reservoir tank accompanied by the discharged treating liquid being returned to said fabric reservoir tank.

12. Apparatus for wet treatment of a fabric as an endless rope according to claim 11, in which said treating liquid directing means on said upper surfaces comprises upstanding projections thereof disposed spaced laterally and spaced in the direction of advancement of the fabric in relative positions for effecting said lateral flow of treating liquid of the jet flow discharged from the fabric delivery tube.

13. Apparatus for wet treatment of a fabric as an endless rope according to claim 12, in which said upstanding projections are arranged on said fabric-spreading plate in rows in a direction transversely of said path of advancement of the fabric.

14. Apparatus for wet treatment of a fabric as an endless rope according to claim 11, in which individual upstanding projections have a greater length in a direction transverse to the direction of advancement of the fabric than a dimension in said direction of advancement.

15. Apparatus for wet treatment of a fabric as an endless rope according to claim 11, in which said upstanding projections are convex in cross section.

16. Apparatus for wet treatment of a fabric as an endless rope according to claim 11, incuding another fabric-spreading plate on said curved plate having upper surfaces and treating liquid directing means thereon for directing treating liquor accompanying the advancing fabric transversely to the path of advancement of the fabric and for effectively subjecting the advancing fabric to the lateral flow of the accompanying treating liquid relative to said path of advancement to thereby spread the fabric laterally while it advances longitudinally.

17. Apparatus for wet treatment of a fabric as an endless rope according to claim 16, in which each treating liquid directing means on a respective flow-spreading plate comprises upstanding laterally spaced projections on upper surfaces of the corresponding fabric-spreading plate with which the fabric is in contact as it advances, and the projections having a greater dimension transversely of the path of advancement of the fabric.

18. A method of wet treating a fabric as an endless rope comprising, advancing said fabric longitudinally as an endless rope in an elongate treating bath of treating liquid increasing in depth gradually in the direction of advancement of the fabric for wet treatment in the treating bath, taking a suction from the bath of treating liquid and effecting a jet flow of treating liquid along an enclosed path above the level of the treating liquid in said treating bath for recirculating the treating liquid of said jet flow back to said treating bath and for advancing the fabric longitudinally as said endless rope, while the fabric is advancing directing its travel out of the treating bath into said jet flow, continuously discharging from said enclosed path treating liquid of the jet flow for return back into the treating bath above the level of the treating bath and ejecting the fabric from the jet flow enclosed path when treating liquid of the jet flow is discharged for return thereof back into the treating bath, while advancing longitudinally the ejected fabric continuously developing relative to a path of advancement of the discharged fabric lateral flow of the discharged treating liquid and simultaneously subjecting the advancing fabric to said lateral flow effective to spread laterally the fabric endless rope under control of the discharged treating liquid, while spreading the fabric allowing the spread fabric to fall to a lower level above the level of the treating liquid in said treating bath accompanied by discharged treating liquid, continuously developing relative to a path of advancement of the discharged fabric at the lower level a second lateral flow of falling discharged treating liquid and simultaneously subjecting the advancing spread fabric to said second lateral flow effective to spread the fabric laterally relative to the path of advancement thereof at said lower level, and smoothly guiding the spread fabric from said lower level into the treating bath.

19. A method of wet treating a fabric as an endless rope comprising, advancing said fabric longitudinally as an endless rope in an elongate treating bath of treating liquid increasing in depth gradually in the direction of advancement of the fabric for wet treatment in the treating bath, taking a suction from the bath of treating liquid and effecting a jet flow of treating liquid along an enclosed path above the level of the treating liquid in said treating bath for recirculating the treating liquid of said jet flow back to said treating bath and for advancing the fabric longitudinally as said endless rope, while the fabric is advancing directing its travel out of the treating bath into said jet flow, continuously discharging from said enclosed path treating liquid of the jet flow for return back into the treating bath above the level of the treating bath and ejecting the fabric from the jet flow enclosed path when treating liquid of the jet flow is discharged for return thereof back into the treating bath, while advancing longitudinally the ejected fabric continuously developing relative to a path of advancement of the discharged fabric lateral flow of the discharged treating liquid and simultaneously subjecting the advancing fabric to said lateral flow effective to spread laterally the fabric endless rope under control of the discharged treating liquid, while spreading the fabric allowing the spread fabric accompanied by discharged treating liquid to fall to a lower level above the level of the treating liquid in said treating bath on to a curved plate extending from said lower level into said treating bath for smoothly guiding the spread fabric into said treating bath.

* * * * *